US008701214B2

(12) United States Patent
Stoneham

(10) Patent No.: US 8,701,214 B2
(45) Date of Patent: Apr. 22, 2014

(54) ONE-PIECE GARMENT

(76) Inventor: Paul David Stoneham, Fort Worth, TX (US)

( * ) Notice: Subject to any disclaimer, the term of this patent is extended or adjusted under 35 U.S.C. 154(b) by 221 days.

(21) Appl. No.: 12/928,477

(22) Filed: Dec. 13, 2010

(65) Prior Publication Data

US 2011/0179547 A1 Jul. 28, 2011

Related U.S. Application Data

(60) Provisional application No. 61/297,997, filed on Jan. 25, 2010.

(51) Int. Cl.
*A41D 1/06* (2006.01)
*A41D 13/02* (2006.01)

(52) U.S. Cl.
USPC ..... 2/79

(58) Field of Classification Search
USPC ..... 2/114, 70, 79, 83, 121, 122, 80, 75, 69
See application file for complete search history.

(56) References Cited

U.S. PATENT DOCUMENTS

| | | | | | |
|---|---|---|---|---|---|
| 1,678,629 | A * | 7/1928 | Benz et al. | 2/122 |
| 2,224,684 | A * | 12/1940 | Jacobs et al. | 450/104 |
| 2,374,299 | A * | 4/1945 | O'Hara | 2/69.5 |
| 2,425,635 | A * | 8/1947 | Nitzberg | 2/75 |
| 2,462,165 | A * | 2/1949 | Condon | 2/69.5 |
| 2,607,041 | A * | 8/1952 | Williamson | 2/122 |
| 2,647,261 | A * | 8/1953 | Rassner | 40/586 |
| 3,281,863 | A * | 11/1966 | Beard et al. | 2/113 |
| 4,304,006 | A * | 12/1981 | Swart | 2/49.1 |
| 4,853,976 | A * | 8/1989 | Mertz | 2/67 |
| 4,922,551 | A * | 5/1990 | Anthes | 2/79 |
| 5,109,546 | A * | 5/1992 | Dicker | 2/70 |
| 5,208,918 | A | 5/1993 | Royal | |
| 5,418,978 | A | 5/1995 | Hochman | |
| 5,592,693 | A * | 1/1997 | Jensen et al. | 2/115 |
| 5,713,373 | A | 2/1998 | Argentino | |
| 5,737,773 | A * | 4/1998 | Dicker et al. | 2/69 |
| 5,758,363 | A * | 6/1998 | Winfree | 2/122 |
| 5,778,452 | A * | 7/1998 | Dicker et al. | 2/69 |
| 5,784,717 | A * | 7/1998 | Singer | 2/79 |
| 5,829,058 | A * | 11/1998 | Dicker et al. | 2/69 |
| 5,875,491 | A * | 3/1999 | Wilkinson | 2/69 |
| 5,911,312 | A | 6/1999 | Holyfield | |
| 6,260,200 | B1 | 7/2001 | Alfred | |
| 6,334,221 | B1 | 1/2002 | Hope | |
| 7,143,449 | B2 * | 12/2006 | Young | 2/69 |
| 7,305,717 | B1 | 12/2007 | Brown | |
| 7,665,151 | B1 * | 2/2010 | Finell | 2/49.1 |
| 7,827,619 | B1 | 11/2010 | Steinberg et al. | |
| 2004/0231026 | A1 * | 11/2004 | Young | 2/79 |
| 2009/0293169 | A1 * | 12/2009 | Wise | 2/80 |
| 2009/0313741 | A1 | 12/2009 | Hyman et al. | |

* cited by examiner

*Primary Examiner* — Amber Anderson
(74) *Attorney, Agent, or Firm* — Whitaker Chalk Swindle & Schwartz PLLC; Stephen S. Mosher

(57) ABSTRACT

A one-piece garment is presented, such as a pajama for toddlers, which prevents removal of the garment by the toddler and keeps the toddler from gaining access to his diaper. The one-piece garment may be modified for wearers of any size and/or age so that the wearer cannot remove his own garment or disturb garments or medical devices that are worn under the one-piece garment.

12 Claims, 5 Drawing Sheets

ONE-PIECE GARMENT

CROSS-REFERENCE TO RELATED APPLICATIONS

This application claims priority from U.S. provisional application Ser. No. 61/297,997, filed Jan. 25, 2010.

BACKGROUND OF THE INVENTION

1. Field of the Invention

This invention relates to garments, and in particular relates to a one-piece garment, such as a pajama, that is adapted for children prone to inappropriate clothing removal or accessing of diapers.

2. Description of the Related Art

A normal stage of toddler development often includes the toddler removing his clothes, pajamas or diaper and/or gaining access to the contents of his diaper. Similarly, these behaviors are characteristics of autistic children [Inglese M D and Elder J H. (2009). Caring for children with autism spectrum disorder. Part1: prevalence, etiology and core features. J. Pediatr. Nurs. (24-1): 41-48; Inglese M D. (2009). Caring for children with autism spectrum disorder. Part2: screening, diagnosis, and management. J. Pediatr. Nurs. (24-1): 49-59; Reaven J A. (2009). Children with high-functioning autism spectrum disorders and co-occurring anxiety symptoms: implications for assessment and treatment. J. Spec Pediatr. Nurs. (14-3): 192-99]. In addition to embarrassment for both the child and the caregiver, numerous negative issues arise from diaper removal or access including lack of sanitation, risk of infection, sleep deprivation and emotional distress.

In the prior art, simple placement of a zipper at the back of a garment is known. See for example, U.S. Pat. Nos. 7,305,717, 6,334,221, 5,911,312, 5,713,373 and 5,418,978, which incorporate a zipper down the back of a garment, some including a cover for the zipper pull-tab. These prior inventions, however, do not provide sufficient design features to prevent the wearer from gaining access to an undergarment. The disclosed embodiments of the prior patents might allow the wearer to stretch the neck and arm openings of the garment so that it might be removed or the wearer might gain access to an undergarment. It is therefore an object of the invention herein to provide a one-piece garment, such as a pajama, with added design features that prevent the wearer of the garment from removing the garment and/or inserting the wearer's hands inside the garment.

BRIEF SUMMARY OF THE INVENTION

The invention herein is a one-piece garment, such as a pajama for toddlers, which prevents removal of the pajama by the toddler and keeps the toddler from accessing his diaper. The one-piece garment of the invention may be modified in size for wearers of any age and/or size so that the wearer cannot easily remove his garment or disturb undergarments or medical devices worn under the one-piece garment of the invention. For example, a need for such a garment exists within the Alzheimer's population, where habits such as pulling and tugging at buttons and zippers can lead to inappropriate undressing and embarrassment for the individual as well as family and caregivers [Austrom MG and Lu Y. (2009). Long term caregiving: helping families of persons with mild cognitive impairment cope. Curr. Alzheimer Res. (6-4): 392-98; Kibayashi K and Shojo H. (2003). Accidental fatal hypothermia in elderly people with Alzheimer's disease. Med. Sci. Law. (43-2): 127-31; Cutler N R and Sramek J J. *Understanding Alzheimer's Disease*. University Press of Mississippi. 1996]. Thus, as used herein, the word toddler refers to the wearer of the preferred size of the one-piece garment, but also includes wearers of larger one-piece garments made according to this invention. In the invention herein, garment removal is prevented by placing a zipper on the back of the garment and further covering the zipper pull-tab by a high-tension snap to prevent toddler access. Diaper access is prevented by providing an extended internal yoke that inhibits stretching the garment in the upper torso region, and static shoulder and arm seams to which the yoke is attached. This combination of design features will prevent the toddler from putting his hands and arms inside his pajama. In addition, the collar of the pajama has a low-stretch elastic insert that prevents the toddler from stretching it and pulling the garment down over his shoulders, thus helping to prevent the toddler from removing the garment.

Other objects and features of the invention will be more fully apparent from the following disclosure and appended claims.

DETAILED DESCRIPTION OF THE INVENTION

Broadly, the invention herein generally provides a one-piece pajama garment for a toddler that prevents opening of the garment's back zipper and prevents access to inside the garment by the garment wearer's hands. This in turn prevents the wearer from removing the garment and/or gaining access to his diaper. While the present invention is most preferably a one-piece garment for toddlers, garments according to the invention may be made for wearers of any age.

In an exemplary embodiment of the invention herein, the zipper is centered on the back side of the pajama and spans the length of the garment, running from the collar to the bottom of one of the legs. The high-tension snap/zipper pull-tab cover is sewn onto the collar and covers the entire zipper pull-tab by attaching over the zipper pull-tab and snapping on the opposing side. As used herein, the term yoke includes an internal yoke, an external yoke, or an alternate band as described herein, each of which function to prevent stretch of the garment. The extended internal yoke is sewn into the interior of the pajama and is anchored into the low-stretch elastic collar, the static arm seams and the static shoulder seams. This functions as an overall harness, preventing pajama stretch and diaper access. As used herein, the term static seam includes any method that keeps the particular seam from stretching, such as sewing non-stretch tape along the seam, or use of a non-stretch thread to sew the seam. The shoulder and arm seams are made static by sewing them with a non-elastic thread, by anchoring them with a non-elastic ribbon, or by other means known in the garment craft. The lack of stretch in the static arm seams inhibits the toddler's ability to slip hands and arms inside, thereby preventing access to the diaper. The lack of stretch in the static shoulder seams works in conjunction with the low-stretch elastic collar, preventing the toddler from creating sufficient space to pull the pajama down past his shoulders, thereby preventing garment removal. The low-stretch elastic collar also inhibits gaining access to the diaper by restricting the stretch of the upper torso of the pajama. Alternatively, a non-elastic band may be used instead of the low-stretch material inside the collar.

The pajama is designed to inhibit pajama removal and to prevent diaper access by the toddler. The back placement of the zipper, combined with the low-stretch elastic collar, is a deterrent for toddlers inclined to remove their pajama. The high-tension snap/zipper pull-tab cover further prevents the toddler from accessing and unzipping the garment. The extended internal yoke, combined with the static arm and shoulder seams, prevents lateral stretch of the upper torso of the pajama, thereby preventing the toddler from creating sufficient space in the upper torso of the garment to place his hands and arms down and inside the pajama, therefore gaining diaper access.

Figure 3:
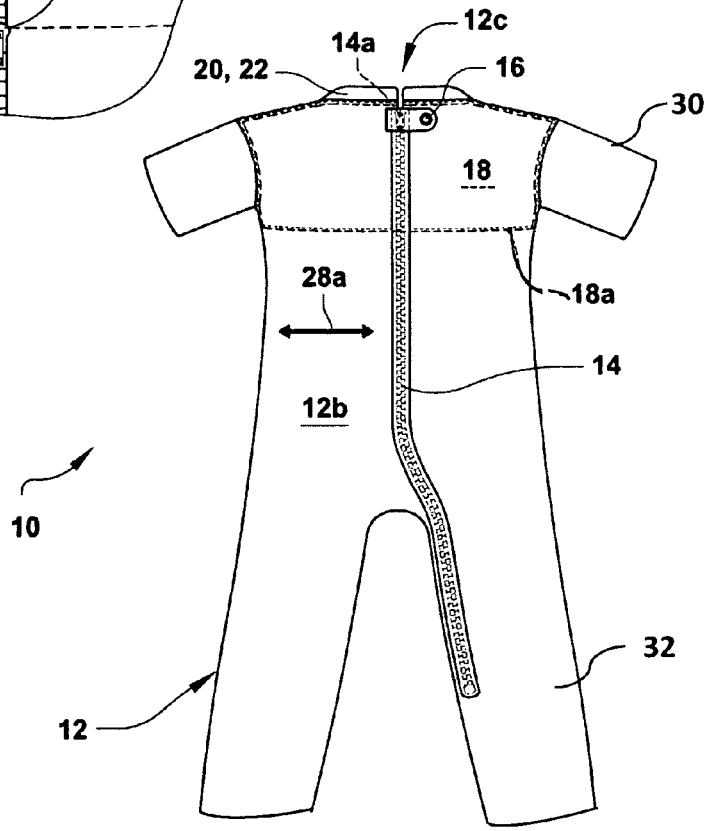
FIG. 3 is a back elevation view of an alternate embodiment of the invention, in which the sleeve parts, leg parts and zipper are different from the preferred embodiment.

Static arm and shoulder seams as well as the extended internal yoke and the low-stretch elastic collar are necessary to prevent diaper access in the preferred embodiment of the invention herein. Additional elements of this invention include the back zipper placement and snap/zipper pull-tab cover. These features provide additional benefits, previously described as preventing pajama removal. For example, the zipper placement and high-tension snap/zipper pull-tab cover are deterrents for pajama removal by the toddler and could be changed or amended. As alternate options, the zipper might not extend the entire length of the leg (see FIG. 3) or the snap/zipper pull-tab cover might not be used. Additionally, the size, orientation and placement of the zipper might be modified to achieve more or less effectiveness in preventing garment removal in consideration of the gain or loss of comfort to the wearer.

Referring in greater detail to the Figures, the following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 4:
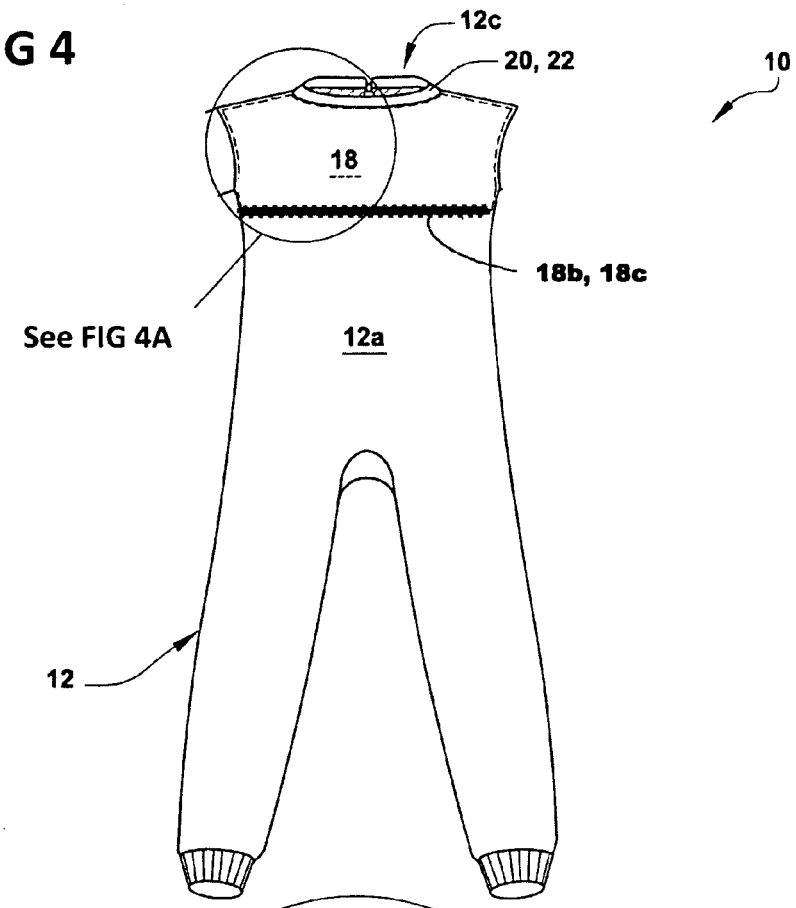
FIG. 4 is a front elevation view of an alternate embodiment of the invention, in which a static seam or non-stretch tape substitutes for the internal yoke of the preferred embodiment.
Figure 4A:
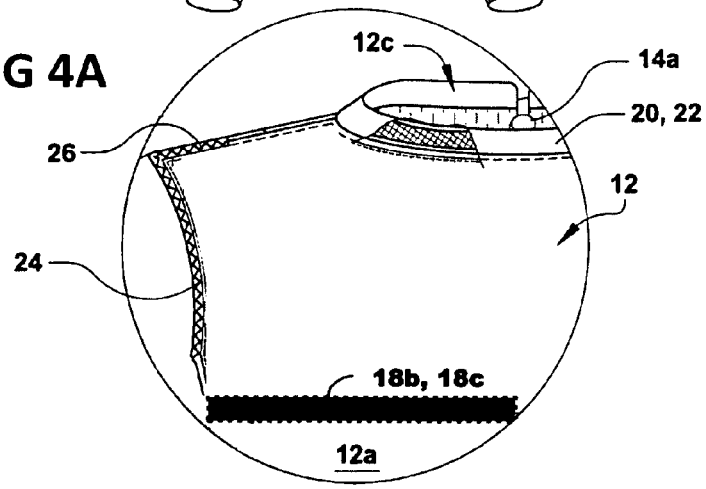
FIG. 4A is an enlarged view taken from FIG. 4 showing the features of the shoulder and arm seams, and the low-stretch tape substitution for the internal yoke.

The garment of the invention, shown in the figures as the preferred embodiment comprising pajama 12 of the invention 10, has a front part 12*a* (FIG. 1), a back part 12*b* (FIGS. 2 and 3), and a neck opening 12*c* (FIGS. 1 to 5). The pajama preferably also has two sleeve parts 30 that can vary in length and two leg parts 32 that can vary in length. Alternately, as shown in FIG. 4, the garment may be made without sleeve parts.

Figure 1:
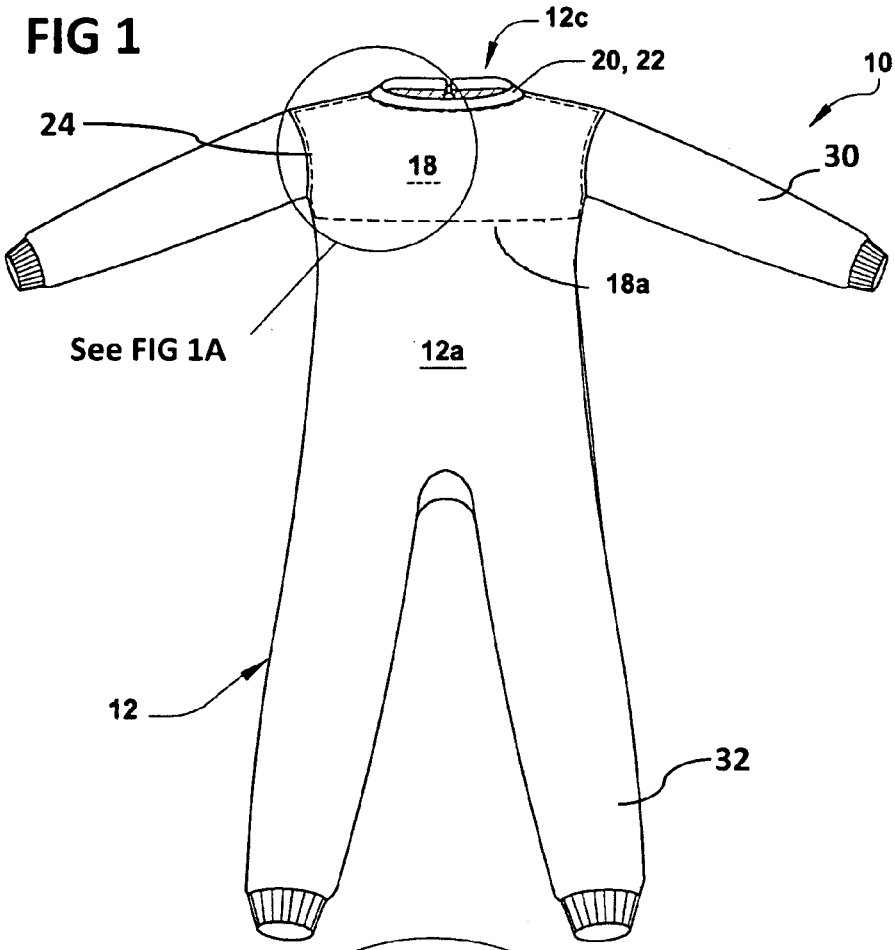
FIG. 1 is a front elevation view of the invention according to an exemplary embodiment.
Figure 1A:
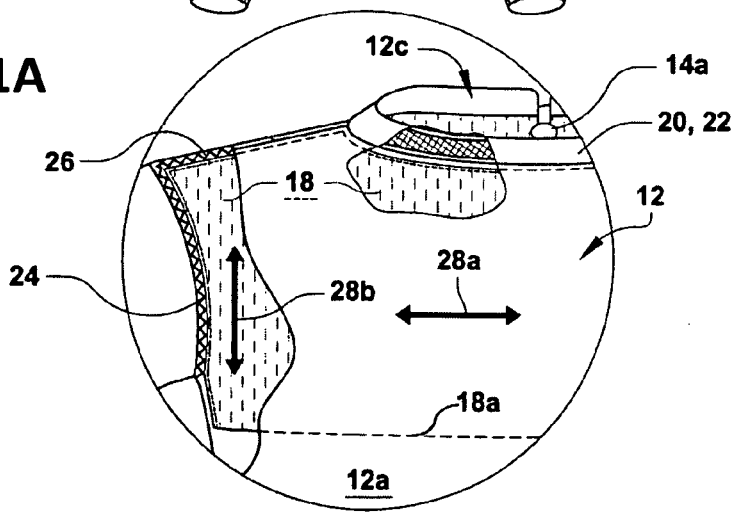
FIG. 1A is an enlarged detail view taken from FIG. 1 with portions partially cut away to show features of the collar, shoulder seams and arm seams, and internal yoke.
Figure 2:
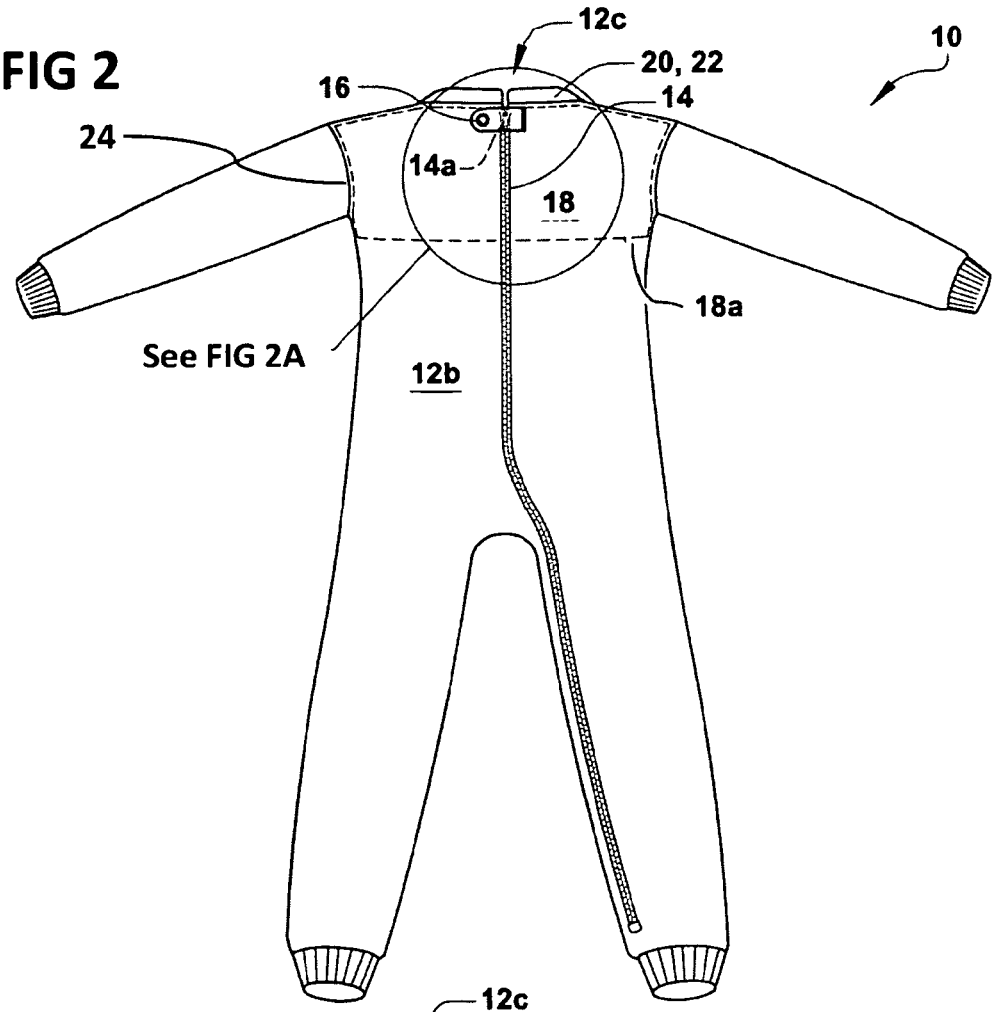
FIG. 2 is a back elevation view of the invention according to the exemplary embodiment of FIG. 1.
Figure 2A:
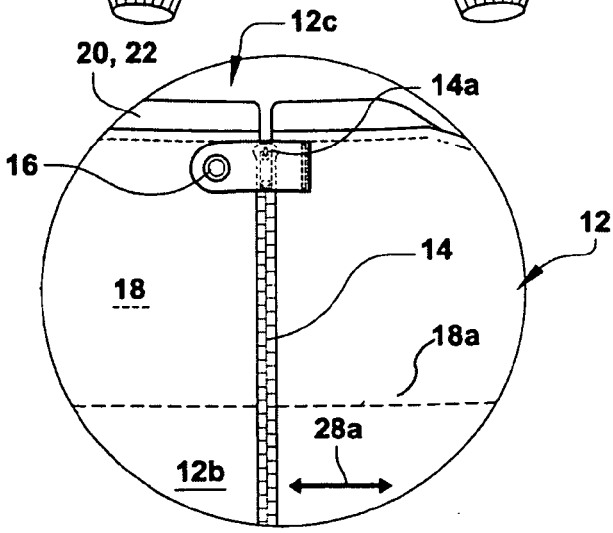
FIG. 2A is an enlarged detail view taken from FIG. 2 showing the features of the zipper, pull-tab, and high-tension snap cover.
Figure 2B:
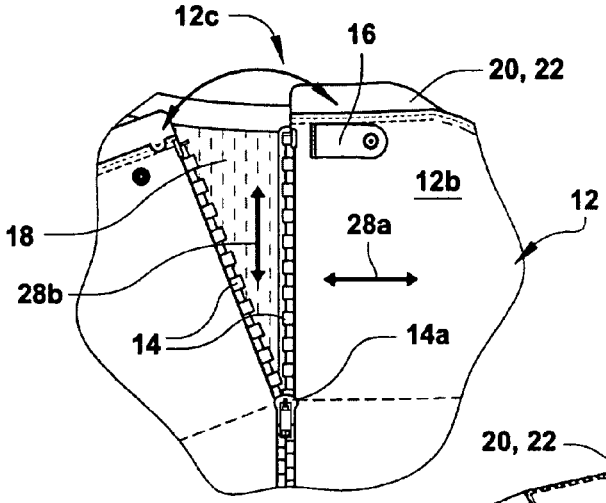
FIG. 2B is an enlarged detail view taken from FIG. 2 showing the features of the opened zipper.

The back part 12*b* of the garment preferably comprises a back zipper closing 14 extending from the neck opening to a location on the garment below the closing 14 that is sufficient to allow dressing the wearer or removing the garment from the wearer. Preferably the back zipper closing extends from the neck opening of the garment 12*c* to the bottom of a leg part 32. There can be a collar part 20 at the neck opening 12*c*, and there can be a low-stretch elastic piece 22 inside the collar part 20 (FIG. 1A). The top of the back zipper 14 can have a pull-tab 14*a*, which can be covered by a high-tension snap/zipper pull-tab cover 16 when the back zipper 14 is closed.

In the preferred embodiment, the pajama has an internal yoke part 18 extending across the part of the garment that covers the chest and the back of the wearer. The internal yoke part 18 can be sewn into the garment so that it is anchored at sites including the neck opening 12*c*, the shoulder seams 26, the zipper 14 and the arm seams 24. Assuming the extended internal yoke part 18 is made of the same fabric as the body of the garment, the grain of the fabric of yoke part 18 preferably lies at a 90 degree angle to the grain of the fabric of the pajama 12. By this means, the lateral stretch 28*a* of the fabric of pajama 12 and the vertical stretch 28*b* of the fabric of the yoke part 18 can oppose each other to reduce elasticity. The lower edge 18*a* of the internal yoke part 18 can remain free or it can be stitched across the front part 12*a* of the garment and across each of the two sides of the back part 12*b*. Optionally, the lower edge of the extended internal yoke part 18 is sewn 18*b* across the front of the pajama and/or across each side of the back of the pajama.

Alternatively to a yoke part 18 to reduce stretch of the upper portion of the garment as in the preferred embodiment, the yoke part 18 of the invention may simply be replaced by a piece of non-stretching material 18*c*, referred to herein as an alternate band, such as a strip of tape, binding or static seam placed across the chest area and each side of the back area of the garment at the location of the lower area of the yoke that is shown in FIG. 4, essentially defining the bottom of the yoke area. The chosen modality, such as a piece of bias tape, may be sewn to the garment along its entire length or may be attached at its ends to the underarm areas of the garment.

Figure 5:
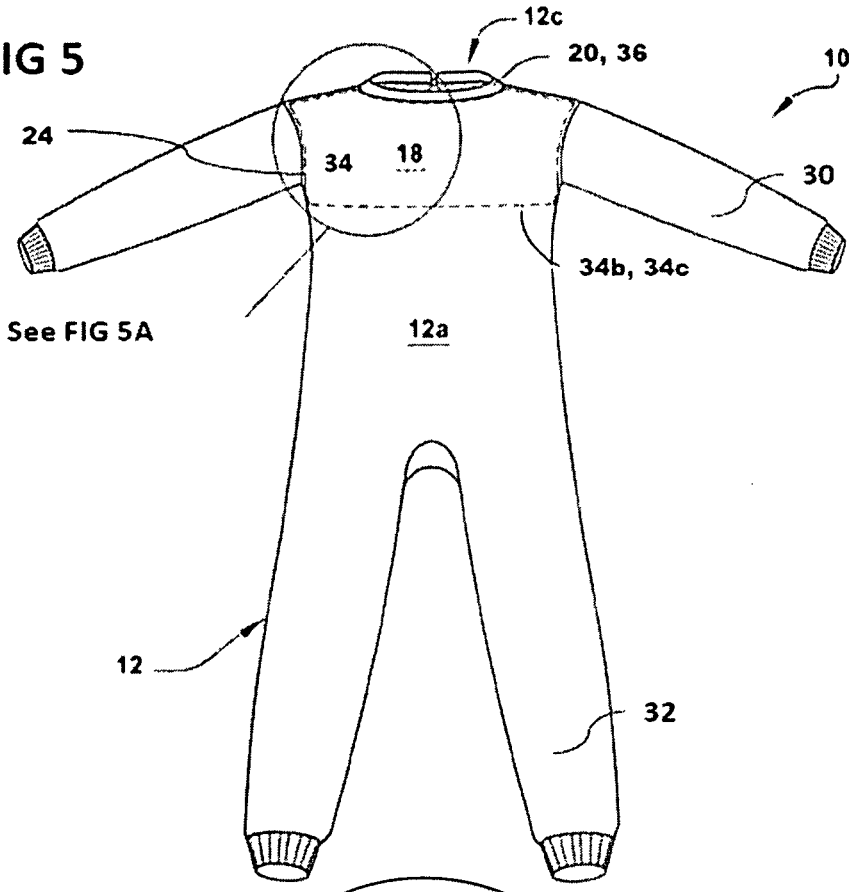
FIG. 5 is a front elevation view of an alternate embodiment of the invention, in which the yoke is attached external to the garment.
Figure 5A:
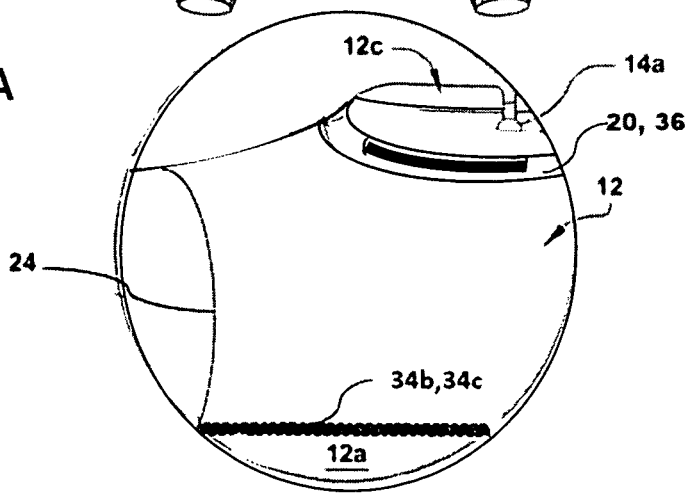
FIG. 5A is an enlarged detail view taken from FIG. 5 showing the features of yoke attached external to the garment.

Other alternatives are to place a yoke 34 (with lower edge sewn 34*b*) or binding 34*c* outside the garment, on the front part 12*a* or the back part 12*b* of the garment, or both (see FIG. 5). Additionally, a non-elastic band 36 may be used inside the collar part 20 instead of the low-stretch elastic piece 22.

Among the advantages of the garment 12 of the invention 10 is that it can prevent a toddler from removing it and/or gaining access to his diaper. The features that prevent pajama removal and/or diaper access may include the stretch-inhibiting static arm seams 24 that may prevent the toddler from slipping his hands and arms inside the pajama 12, and the stretch-inhibiting static shoulder seams 26, in conjunction with the low-stretch elastic 22 in the collar part 20, that may prevent the toddler from creating sufficient space to pull the pajama down past his shoulders.

Pajama removal is also prevented by the placement of the zipper 14 on the back part 12*b* of the garment and further by covering the zipper pull-tab 14*a* with a high-tension snap/zipper cover 16. The inclusion of an extended internal yoke part 18 can prevent stretch of the garment around the upper torso that would allow the wearer to pull his arms from the sleeves or arm hole into the body of the garment 12. All of these features of the garment 12 cooperate to inhibit pajama removal and prevent interior access by the wearer. To use the garment, the diapered toddler or alternative person to be dressed in the one-piece garment of the invention can be placed into the unzipped garment 12 with the zipper 14 at the back part 12*b*. The garment can then be zipped up to the neck opening 12*c* and the high-tension snap/zipper pull-tab cover 16 snapped over the zipper pull-tab 14*a*.

The garment of the invention can be made by methods known to those in the clothing fabrication trade. The components as shown in FIGS. 1 to 5 are sewn together as a conventional pajama, except with the addition of those features that prevent stretching and removal of the garment 12. For example, removal-inhibiting features to be included can be considered, such as the placement of the zipper 14 on the back part 12*b* of the garment and the addition of the high-tension snap/zipper pull-tab cover 16 at the back of the neck opening 12*c* over the zipper pull-tab 14*a*. Stretch-preventing features that can be integrated into the garment are the stretch-inhibiting static seams at the arms 24 and shoulders 26, the low-stretch elastic strip 22 at the collar part 20 and the presence of the extended internal yoke 18. One skilled in the art of clothing fabrication would understand how to create this pajama based on the drawings and the list of components. The usual components of a "normal" pajama are sewn together, and the necessary components (static shoulder seam 26, static arm seam 24, extended internal yoke part 18 and low-stretch elastic 22 and collar part 20) are substituted for the "normal" pajama components. Assuming the extended internal yoke part 18 is made of the same fabric as the body of the garment, it is most preferred that the fabric of the extended internal yoke part 18 lie at 90 degrees to the fabric of the pajama, to minimize elasticity so that the pajama fabric stretches laterally and the yoke fabric stretches vertically; i.e., each restrains the other from stretching in the alternate direction. It is recognized that merely using two layers of fabric—even with the fabric grains in the same direction—somewhat reduces the ability to stretch, but the nearer to 90 degrees, the more effective the restraint. It is the intent of this invention to limit the lateral stretch ratio of the upper region of the garment to a maximum of 1.2 to 1; that is, to limit the elongation of the upper region of the garment in the lateral direction to 20% beyond the original.

The described features of the garment not only prevent the toddler from removing it but also prevent him from accessing a diaper. A normal stage of child development includes the urge to remove clothing, including pajamas and potentially diapers, which can create an unsanitary environment, increase the risk of infection, and cause sleep deprivation and emotional stress felt by the child as well as parents and caregivers.

As diaper access and clothing removal are not limited to hours when toddlers or autistic children sleep, it would be beneficial to extend this invention to other clothing items. In addition, other individuals with special needs, such as those with Alzheimer's symptoms could benefit from the use of this invention in sleepwear and other clothing.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A garment for inhibiting removal by a wearer, comprising:

a coverall garment having a one-piece upper body portion and lower body portion, and an internal yoke attached to said upper body portion;

said one-piece upper body portion closed at a top thereof except for a neck opening and left and right sleeves disposed adjacent said top thereof on either side of said upper body portion at respective left and right arm locations, said upper body portion having a front side and a back side and formed of a fabric having a grain disposed in a first direction; and said internal yoke attached to an inside of said front and back side of said upper body portion with non-stretching seam materials at defined locations including arm seams disposed around a junction of each said left and right sleeves with said upper body portion, along said neck opening, and along left and right shoulder seams extending from said neck opening along said top thereof to each said arm seam, said internal yoke formed of a fabric having a grain disposed in a second direction approximately 90 degrees transverse to said first direction; wherein said one-piece upper body portion and said internal yoke combine to limit the amount of stretch of the garment and to prevent access by said wearer to said lower body portion of said coverall garment and to prevent removal of said coverall garment by said wearer.

2. The garment of claim 1, further comprising:

a split formed in said neck opening and said back side of said upper body portion and said internal yoke, said split extending downward from said neck opening into said lower body portion, said split including a zipper fastener attached therealong said split on each respective first and second sides thereof, and said split formed in said neck opening including a tab closure disposed on a first side of said split in said neck opening across said split in said neck opening, said tab closure including a first part of a high-tension snap fastener; and a collar formed of a non-stretch material sewn to said neck opening and having a second part of a high-tension snap fastener attached to a second side of said split in said neck opening.

3. The garment of claim 2, wherein:

said collar includes an elastic band and a non-elastic band that prevents stretching said elastic band beyond the length of said non-elastic band.

4. The garment of claim 1, wherein further said garment includes:

first and second legs formed integrally with said lowermost part of said upper body portion.

5. The garment of claim 1, wherein:

said zipper fastener extends from said neck opening into said lower body portion to a location that is sufficient to allow dressing the wearer or removing the garment from the wearer.

6. The garment of claim 1, wherein:

the combination of the upper body portion and the internal yoke is constructed so that the amount of stretch in a lateral direction across said upper body portion of the garment is limited to a ratio of 1.2 to 1.0.

7. The garment of claim 1, wherein:

a lower edge of said internal yoke on both inside front and inside back sides thereof is secured to said upper portion of the garment at a location between a lower portion of said left and right arm locations of the garment.

8. The garment of claim 1, wherein:

said first direction is characterized by lateral stretch and said second direction is characterized by vertical stretch.

9. The garment of claim 1, wherein:

said first direction is characterized by vertical stretch and said second direction is characterized by lateral stretch.

10. The garment of claim 1, wherein:

said shoulder seams and said arm seams are static seams, sewn with inelastic thread.

11. A garment for inhibiting removal by a wearer, comprising:

a coverall garment having a one-piece upper body portion and lower body portion, and an external yoke attached to said upper body portion;

said one-piece upper body portion closed at a top thereof except for a neck opening and left and right sleeves disposed adjacent said top thereof on either side of said upper body portion at respective left and right arm locations, said upper body portion having a front side and a back side and formed of a fabric having a grain disposed in a first direction; and said external yoke attached to an outside of said front and back side of said upper body portion with non-stretching seam materials at defined locations including arm seams disposed around a junction of each said left and right sleeves with said upper body portion, along said neck opening, and along left and right shoulder seams extending from said neck opening along said top thereof to each said arm seam, said external yoke formed of a fabric having a grain disposed in a second direction approximately 90 degrees transverse to said first direction; wherein said one-piece upper body portion and said external yoke combine to limit the amount of stretch of the garment and to prevent access by said wearer to said lower body portion of said coverall garment and to prevent removal of said coverall garment by said wearer.

12. The garment of claim 11, further comprising:

a split formed in said neck opening and said back side of said upper body portion and said external yoke, said split extending downward from said neck opening into said lower body portion, said split including a zipper fastener attached therealong said split on each respective first and second sides thereof, and said split formed in said neck opening including a tab closure disposed on a first side of said split in said neck opening across said split in said neck opening, said tab closure including a first part of a high-tension snap fastener; and a collar formed of a non-stretch material sewn to said neck opening and having a second part of a high-tension snap fastener attached to a second side of said split in said neck opening.

* * * * *